US010619383B2

(12) United States Patent
Bacallao

(10) Patent No.: US 10,619,383 B2
(45) Date of Patent: Apr. 14, 2020

(54) TETHER SYSTEM

(71) Applicant: Walmart Apollo, LLC, Bentonville, AR (US)

(72) Inventor: Yurgis Mauro Bacallao, Centerton, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 99 days.

(21) Appl. No.: 16/005,053

(22) Filed: Jun. 11, 2018

(65) Prior Publication Data

US 2018/0363333 A1 Dec. 20, 2018

Related U.S. Application Data

(60) Provisional application No. 62/519,460, filed on Jun. 14, 2017.

(51) Int. Cl.

| | |
|---|---|
| ***E05B 73/00*** | (2006.01) |
| ***G08B 13/14*** | (2006.01) |
| ***A47F 7/024*** | (2006.01) |

(52) U.S. Cl.

CPC ..... *E05B 73/0082* (2013.01); *A47F 7/0246* (2013.01); *E05B 73/0005* (2013.01); *E05B 73/0023* (2013.01); *G08B 13/14* (2013.01)

(58) Field of Classification Search

CPC ... G08B 13/14; E05B 73/0082; E05B 73/005; E05B 73/0023; A47F 7/0246

See application file for complete search history.

(56) References Cited

U.S. PATENT DOCUMENTS

| | | | |
|---|---|---|---|
| D31,591 | S | 10/1899 | Fox |
| 1,681,210 | A | 8/1928 | Banks |
| 1,715,715 | A | 6/1929 | McVey |
| 1,922,935 | A | 8/1933 | Du Bois |
| 1,937,994 | A | 12/1933 | Taylor |
| 2,677,520 | A | 5/1954 | Marcy |

(Continued)

OTHER PUBLICATIONS

Tram-browning, "L-Bracket 1255 3/4 Hole Stainless Steel NMO 3/4 Hole Mount L Bracket Mobile Antennas Motorola Kenwood Vertex HYT for UHF VHF Coam NMO Mount Cable Mobile Antennas Car Truck Hood install by tram-browning", Amazon.com, first accessed on May 27, 2016; 5 pages.

(Continued)

*Primary Examiner* — Eret C McNichols
(74) *Attorney, Agent, or Firm* — Schmeiser, Olsen & Watts LLP; Karen E. Jachimowicz

(57) ABSTRACT

A tether system is described that tethers a mobile computing device to a base. The tether system allows the mobile computing device to be used by individuals, but does not allow the mobile computing device to be moved further away from the base than the length of the tether. The tether system includes a tether cord with a first end coupled to the base, and a second end coupled to a coupling apparatus. The base can be a fixed structure, or can be coupled to a fixed structure, at the location where the mobile computing device is kept. The coupling apparatus is coupled to the mobile computing device. With the coupling apparatus coupling one end of the tether cord to the mobile computing device, and the other end of the tether cord coupled to the base, the tether system couples the mobile computing device to the base.

15 Claims, 8 Drawing Sheets

(56) References Cited

U.S. PATENT DOCUMENTS 2,891,756 A 6/1959 Packard
3,076,627 A 2/1963 Huron
D242,510 S 11/1976 Enckler
4,066,231 A * 1/1978 Bahner ..... B43M 99/00 248/289.11
D254,051 S 1/1980 Zaleski
D287,817 S 1/1987 Henin
D299,809 S 2/1989 Hagedorn
D327,214 S 6/1992 Stuart
5,146,205 A * 9/1992 Keifer ..... A47F 7/024 340/540
D349,640 S 8/1994 Whitaker
D357,400 S 4/1995 Sachs
5,454,537 A 10/1995 Meeker
D379,144 S 5/1997 Hunter et al.
D397,606 S 9/1998 Tameling
D408,266 S 4/1999 Santiago
D411,098 S 6/1999 Vogels
D420,278 S 2/2000 Coffy et al.
D427,888 S 7/2000 Hannon
D432,901 S 10/2000 Mcdonald
6,285,758 B1 9/2001 Lu
6,476,717 B1 * 11/2002 Gross ..... A47F 7/024 340/568.1
6,511,251 B2 1/2003 Bowell
6,581,421 B2 * 6/2003 Chmela ..... E05B 73/0005 403/291
6,659,382 B2 * 12/2003 Ryczek ..... A45F 5/004 242/379
6,711,921 B1 3/2004 Yang
6,761,579 B2 * 7/2004 Fort ..... H02G 11/00 340/568.1
6,769,750 B2 8/2004 Hughes et al.
6,831,560 B2 * 12/2004 Gresset ..... A47F 7/024 340/568.2
6,957,978 B2 10/2005 Zoller
D513,969 S 1/2006 Schurr et al.
D516,023 S 2/2006 Quinn
D516,394 S 3/2006 Chen
7,048,246 B2 * 5/2006 Leyden ..... E05B 73/0005 248/187.1
7,154,039 B1 12/2006 Marszalek et al.
7,162,278 B2 * 1/2007 Vanselous ..... H04M 1/04 455/346
D537,324 S 2/2007 Worrall et al.
D542,632 S 5/2007 Hill
D546,366 S 7/2007 Dittmer
7,264,863 B2 9/2007 Haymond
D573,008 S 7/2008 Sipe
D574,222 S 8/2008 Golias, Jr. et al.
D576,633 S 9/2008 Muday et al.
D578,816 S 10/2008 Goodman et al.
D584,553 S 1/2009 Goodman et al.
D606,384 S 12/2009 Antonic
D608,111 S 1/2010 Rubin
7,724,135 B2 * 5/2010 Rapp ..... A47F 7/024 211/119.003
7,724,520 B2 5/2010 Allen
D631,735 S 2/2011 Johnson
7,971,845 B2 * 7/2011 Galant ..... A47F 5/16 174/50
D643,708 S 8/2011 Hecht
8,077,449 B2 12/2011 Mi et al.
8,103,155 B2 1/2012 Dannenberg et al.
D660,307 S 5/2012 Huang
D674,637 S 1/2013 London
8,413,943 B1 * 4/2013 Li ..... F16M 11/041 248/292.12
8,418,514 B1 4/2013 Su
8,548,536 B1 10/2013 Gunnip
D700,593 S 3/2014 Xiang
D705,040 S 5/2014 Konrad et al.
8,713,858 B1 5/2014 Xie
8,729,852 B2 5/2014 Tsai et al.
D711,736 S 8/2014 Strom et al.
D714,616 S 10/2014 Walker et al.
8,869,573 B2 10/2014 Myers et al.
D726,174 S 4/2015 Wahlin
D729,766 S 5/2015 Luijben et al.
9,022,337 B2 5/2015 Petruskavich
D734,305 S 7/2015 Wengreen
9,097,379 B1 * 8/2015 Strasser ..... F16M 11/04
9,115,846 B2 8/2015 Maier et al.
9,128,668 B2 9/2015 Johnson
9,131,195 B2 9/2015 Wengreen et al.
9,165,174 B2 10/2015 Huck
9,179,565 B2 11/2015 Cho
D744,459 S 12/2015 Cummings et al.
9,272,829 B2 3/2016 Wynnick et al.
D761,236 S 7/2016 Wengreen
D766,601 S 9/2016 Barre et al.
9,454,917 B1 9/2016 King et al.
D771,476 S 11/2016 Prince et al.
D744,317 S 12/2016 Densberger et al.
D774,753 S 12/2016 Moreau et al.
D774,754 S 12/2016 Moreau et al.
D776,745 S 1/2017 Bennett et al.
D776,746 S 1/2017 Bennett et al.
D795,266 S 8/2017 Williams
D796,302 S 9/2017 Bright et al.
D811,199 S 2/2018 Bacallao
9,933,107 B2 4/2018 King et al.
D821,850 S 7/2018 Tyrer
10,026,281 B2 * 7/2018 Henson ..... G08B 25/10
D829,216 S 9/2018 Belitz et al.
10,084,499 B2 9/2018 Bacallao et al.
D831,876 S 10/2018 Moon
2002/0033436 A1 3/2002 Peng et al.
2002/0148935 A1 10/2002 Chambers
2003/0041631 A1 3/2003 Yin
2006/0233601 A1 10/2006 Crain et al.
2007/0007412 A1 1/2007 Wang
2007/0295870 A1 12/2007 Peterson et al.
2008/0079388 A1 4/2008 Samowsky et al.
2008/0169393 A1 7/2008 Wang et al.
2008/0283694 A1 11/2008 VanLanen et al.
2009/0079566 A1 * 3/2009 Goldstein ..... A47F 7/024 340/568.1
2009/0173868 A1 * 7/2009 Fawcett ..... A47F 7/024 248/551
2010/0039762 A1 2/2010 Watson
2011/0068919 A1 * 3/2011 Rapp ..... A47F 7/024 340/568.2
2011/0157805 A1 6/2011 Mi et al.
2011/0187531 A1 * 8/2011 Oehl ..... G08B 13/1445 340/568.1
2012/0091086 A1 4/2012 Gregory et al.
2012/0217371 A1 * 8/2012 Abdollahzadeh ... E05B 15/1607 248/551
2013/0063267 A1 * 3/2013 Yunker ..... H03K 17/962 340/571
2013/0092805 A1 4/2013 Funk
2013/0093386 A1 4/2013 Tsai et al.
2013/0153720 A1 6/2013 Petruskavich
2013/0161054 A1 6/2013 Allison et al.
2013/0278050 A1 10/2013 Maier et al.
2013/0320163 A1 12/2013 Wong
2014/0028243 A1 1/2014 Rayner
2014/0059828 A1 * 3/2014 Reynolds ..... F16M 11/041 29/428
2014/0091193 A1 4/2014 Simon
2014/0092531 A1 * 4/2014 Trinh ..... A47F 7/024 361/679.01
2014/0106608 A1 * 4/2014 Howarth ..... F16M 13/02 439/531
2015/0041622 A1 2/2015 Mulhern et al.
2015/0070839 A1 3/2015 Johnson
2015/0144754 A1 5/2015 Elharar
2015/0201113 A1 7/2015 Wood
2015/0208826 A1 * 7/2015 Yang ..... E05B 73/0082 248/551
2015/0289396 A1 10/2015 Hwang et al.

(56) References Cited

U.S. PATENT DOCUMENTS

| | | | | |
|---|---|---|---|---|
| 2015/0329062 | A1 | 11/2015 | Ackeret et al. | |
| 2016/0176357 | A1 | 6/2016 | Maslakow | |
| 2016/0204636 | A1 | 7/2016 | Allen et al. | |
| 2017/0018156 | A1* | 1/2017 | Kim | G08B 13/1409 |
| 2017/0058572 | A1 | 3/2017 | Aviganim | |
| 2017/0245663 | A1* | 8/2017 | Berglund | E05B 73/00 |
| 2017/0268716 | A1 | 9/2017 | Hoyda et al. | |
| 2017/0339937 | A1 | 11/2017 | Erdmann | |
| 2017/0347780 | A1 | 12/2017 | Bacallao et al. | |
| 2018/0197389 | A1 | 7/2018 | Grant et al. | |
| 2018/0229093 | A1 | 8/2018 | Givens | |

OTHER PUBLICATIONS

10 Units crank angle bracket plastic frame angular DIY model accessories, AliExpress.com, first accessed May 27, 2016; 12 pages.
Repe, "High Rated Brush Coating Finish Plastic Composite Railing Metal L Shape WPC Clip Accessory", TimberCompositeDecking.com, first accessed May 27, 2016; 2 pages.
Product Photos, DeckMaster.com, first accessed May 27, 2016; 10 pages.
Profis, Sharon, "How to mount your smartphone on a tripod (DIY)", CNET.com, Mar. 26, 2014; 5 pages.
vGaurd, "vG-SDM003 Square Security Display Magnetic Mounting Holder for Cell Phone", WelGaurd.com, first accessed on May 27, 2016; 7 pages.
vGuard, "vG-SDM001 Small Oval Security Display Magnet Mount + Pull Box tehter", AliExpress.com, first accessed on May 27, 2016; 2 pages.
vGuard, "vG-SDM004 Small Round Security Display Magnet Mount + Pull Box", WelGaurd.com, first accessed on May 27, 2016; 6 pages.
AnchorPad, "vRT Medium Retractable Tether with 29.5 Inch Cable for iPods & iPhones", Amazon.com, first accessed on May 27, 2016; 5 pages.
Maurerpe, "Wall Mount for Vtech 6419 Cordless Phone", MakerBot Thingiverse, Apr. 20, 2013; 6 pages.
Generic, "Television/Air Conditioner Remote Control Holder Wall Mount-Storage Box", Amazon.com, first accessed on May 27, 2016; 6 pages.
ZAZZ, "ZAZZ Wall Mount for iPad/Kindle and Tablets (Black)", Amazon.com, first accessed on May 27, 2016; 5 pages.
Plastic Sensor 2.0 Wall Mount Stand Holder for Zbox One Kinect 2.0—Black, Deal Extreme, DX.com, first accessed on May 28, 2016; 4 pages.
Sea-Dog, "Sea-Dog Removable Table Brackets—Stainless Steel", DownwindMarine.com, first accessed on May 28, 2016; 1 page.
Series Accessories: Developed for your Dynaudio loudspeakers, Dynaudio.com, first accessed on May 28, 2016; 6 pages.
Video Mount Products Vented Wall Mount Shelf, CableOrganizer.com, first accessed on May 28, 2016; 3 pages.
Cell Phone Wall Charger Adapter Charging Holder Hanging Support (2-Piece), first accessed on May 28, 2016; 2 pages.
Mid-Century Meets Modern: Gidloof Originals—Tiagosen, DesignMilk.com, Mar. 4, 2013; 14 pages.
"Inon Double Hole Rubber bushing (for fiber optic cable)," Backscatter.com, accessed on Apr. 25, 2017I 2 pages.
Redlinecarparts, "BMW 320D 99-06 Front Wishbone Bush with Bracket Lh O," Ebay.com, accessed on Apr. 24, 2017; 5 pages.
Dardytrading, "Anti-lost Pull Box Anti Theft Recoiler Cable Retracting Display Cable Retracting Security Cable Merchandise Security Tether Security Recoiler," DHGate.com, accessed on Apr. 24, 2017; 11 pages.
"Freedom Micro™," MobileTechnic.com, Mobile Technologies Inc., accessed on Apr. 24, 2017; 5 pages.
"Recent RTF News and Updates: Open display, retail smartphone security devices now produced in Brazil," RTFGlobal.com, accessed on Apr. 24, 2017; 3 pages.
Corner Bracket Levelers, 4 pack, Woodcraft.com, Woodcraft Supply LLC, accessed on Jun. 29, 2016; 2 pages.
HighPoint Corner Bracket Levelers 4-piece, Woodcraft.com, Woodcraft Supply LLC, accessed on Jun. 29, 2016; 2 pages.
Pack of 10 Heavy Duty Corner Braces 50mm Angle Bracket F Plate NEW, Ebay.com, White Hinge Ltd, accessed on Jun. 29, 2016; 4 pages.
Screw-on Corner Braces, 4-Pack, Rockler.com, Rockler Woodworking and Hardware, accessed on Jun. 29, 2016; 6 pages.
Glide Brackets and Systems, USFutaba.com, U.S. Futuba, Inc., accessed on Jun. 29, 2016; 2 pages.
Corner Brace 2-1/2 x 2-1/2 x 3/4 in White Plastic, OvisOnline.com, Ovis division of WIM Corp, accessed on Jun. 29, 2016; 4 pages.
Notice of Allowance in U.S. Appl. No. 29/566,595, dated Jun. 30, 2017; 6 pages.
"Code Reader 2500 CR2500 512G_01 Barcode Scanner w/ Charger + Handle," Ebay.com, accessed on Jun. 15, 2017; 4 pages.
"Wireless Laser Barcode Scanner Label Reader with Charger Base Handheld Barcode Scanning for Supermarket Shop," DHGate.com, accessed on Jun. 15, 2017; 3 pages.
Notice of Allowance in U.S. Appl. No. 29/572,493, dated Dec. 27, 2017; 8 pages.
Non-Final Office Action for U.S. Appl. No. 15/657,693, dated Mar. 22, 2018; 7 pages.
Notice of Allowance in U.S. Appl. No. 29/566,596 dated Jan. 24, 2019; 14 pages.
Notice of Allowance in U.S. Appl. No. 15/602,227 dated Jan. 11, 2019; 11 pages.
Non-Final Office Action in U.S. Appl. No. 15/602,227 dated Aug. 27, 2018.
Notice of Allowance in U.S. Appl. No. 15/657,693 dated Jul. 6, 2018; 5 pages.

* cited by examiner

TETHER SYSTEM

CROSS REFERENCE TO RELATED APPLICATION

This invention claims priority to U.S. provisional patent application Ser. No. 62/519,460, filed Jun. 14, 2017, and entitled "Tether System", which is incorporated entirely herein by reference.

BACKGROUND OF THE INVENTION

Technical Field

This invention relates to tether systems, and specifically to a tether system for tethering a mobile computing device to a base.

State of the Art

Mobile computing devices are in common use, and include any of a multitude of devices that have a computer processor in them. Mobile computing devices include cellular telephones, cameras, mobile computers, tablets, scanners, and many other devices that can be carried around by an individual. Mobile computing devices are, by definition, mobile. This can be a problem when a mobile computing device is used for a task in which the mobile device needs to stay in one location and be used by multiple users. A mobile device that needs to stay at one location may be accidentally, or purposely, be carried off by a user. When this happens, the mobile computing device will no longer be available for other users to use to complete tasks.

Accordingly, what is needed is a tether system to tether a mobile computing device to a base.

DETAILED DESCRIPTION OF EMBODIMENTS OF THE INVENTION

As discussed above, embodiments of the present invention relate to tether systems, and, specifically, to a tether system for tethering a mobile computing device to a base. Mobile computing devices are devices that use a computer processor to perform tasks. Mobile computing devices include cellular telephones, cameras, tablets, scanners, and any other device that can be carried around and that has a computer processor. Because mobile computing devices are mobile, they can be lost or misplaced easily. This can be a problem when a mobile computing device is meant to stay in one location for multiple users to use. The mobile computing device can be accidentally, or purposely, carried away from the intended location, leaving subsequent users unable to use the mobile computing device. The disclosed tether system tethers a mobile computing device to a base. The tether system includes a tether cord, the base, and a coupling apparatus. One end of the tether cord is coupled to the base. The base can be coupled to an immovable structure, or the base itself can be immovable. The tether cord is coupled at the other end to the mobile computing device. Once the tether system is coupled to the mobile computing device and the base is at or near the intended location of the mobile computing device, the mobile computing device is usable by individuals at the intended location, but cannot be removed from the location. The tether system ensures that the mobile computing devices stays near the base so that the mobile computing device is available to be used, but cannot be removed from the location of the base.

Various mobile device tethering systems have been available prior to this invention. These systems are often used for retail environments where the mobile computing device is the item being sold, and it is desirable to tether the mobile computing device to a table or display structure so that consumers can view the mobile computing device but not take it. The disclosed invention was developed to fulfil a different need—the need where the mobile computing device is being used, not being sold, in a retail environment. In this situation, the mobile computing device needs to be at a fixed location so that multiple employees can use the mobile computing device to perform tasks, for example. The disclosed invention uses the base, tether cord, and cap screw of a Sennco Systems™ tether, with a novel cylindrical spacer specifically developed to couple the cap screw to a mobile computing device, creating a novel tether system that tethers a mobile computing device to a base while allowing the mobile computing device to be functional and securely coupled to the tether cord.

Figure 1:
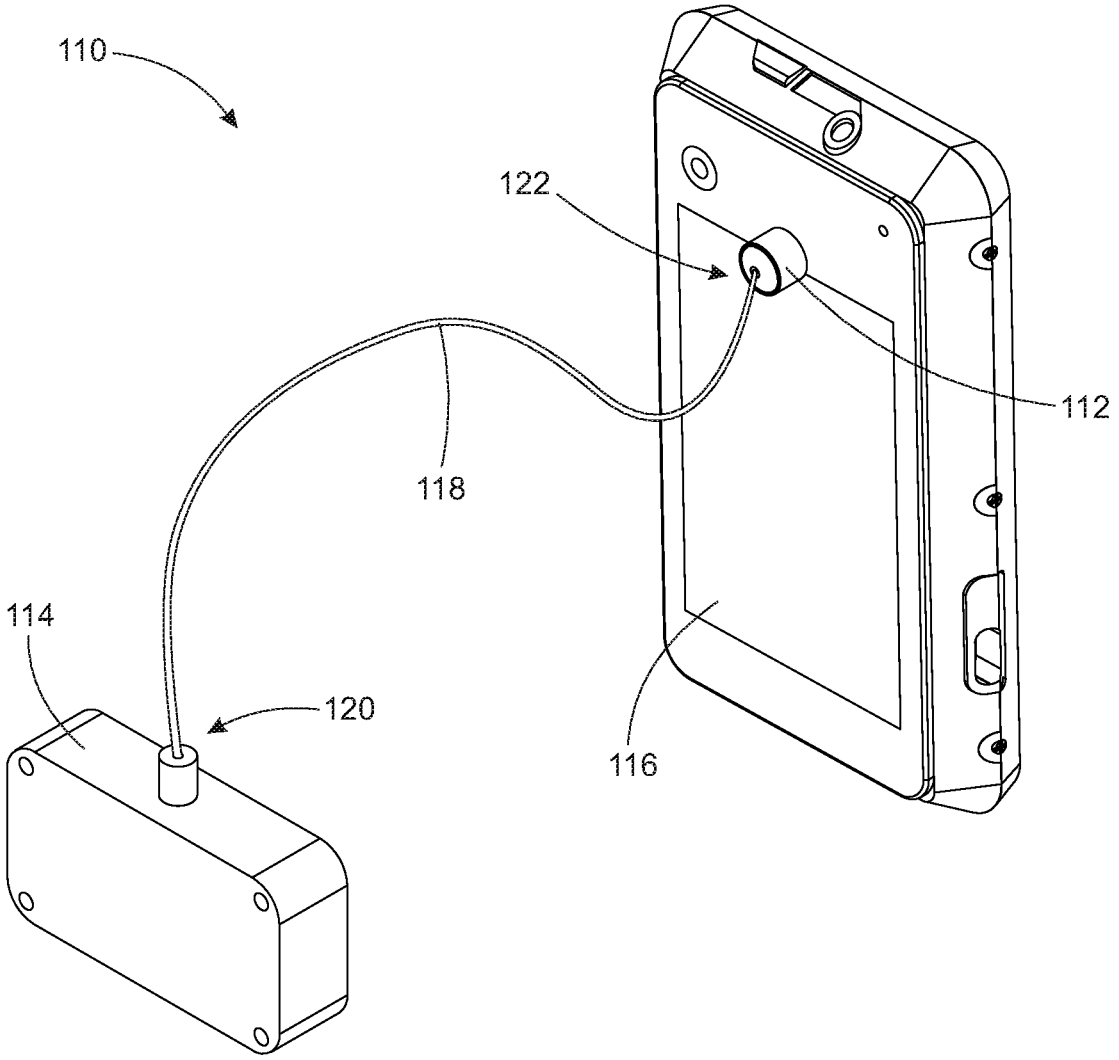
FIG. 1 shows a simplified representation of a tether system coupled to a mobile computing device.

FIG. 1 shows a simplified diagram of a tether system 110, with tether system 110 coupled to a mobile computing device 116. Tether system 110 includes a base 114, a coupling apparatus 112, and a tether cord 118. Tether cord 118 couples coupling apparatus 112 to base 114. Tether cord 118 can be any type of cord, string, or wire that can tether one object to another. In this embodiment, coupling apparatus 112 is coupled to mobile computing device 116. Thus, in this embodiment, tether cord 118 couples mobile computing device 116 to base 114.

Tether cord 118 has a tether cord first end 120 coupled to base 114, and a tether cord second end 122 opposing tether cord first end 120. Tether cord second end 122 is coupled to coupling apparatus 112. Tether cord 118 couples coupling apparatus 112 and mobile computing device 116 to base 114. Base 114 can be secured to any device or structure it is desired to keep mobile computing device 116 near. Base 114 can be coupled to a table, for example, or a wall, a charger for mobile computing device 116, or any other device or structure that mobile computing device 116 is to be kept near. Base 114 can be coupled to a table, for example, but not by way of limitation, where mobile computing device 116 is used by employees to perform tasks. With mobile computing device 116 tethered to base 114, and base 114 coupled to the table, mobile computing device 116 is available at the table for employees to use, but cannot be inadvertently taken from the table because tether system 110 keeps mobile computing device 116 at the table. It is to be understood that base 114 can be coupled to many different types and forms of structures or devices. Base 114 is a rectangular box in this embodiment, but this is not meant to be limiting. Base 114 can take many different forms other than that shown in the figures. In some embodiments, base 114 is a rectangular box with coupling holes so the box can be coupled to an object such as a table, a charger, a wall, etc. In some embodiments, base 114 is a different shape or form of a device to be coupled to another object. In some embodiments, base 114 is a fixed structure such as a table, a wall, a bookcase, a checkout station, or any other fixed structure that it is desired to tether mobile computing device 116 to. In some embodiments, base 114 is the stationary structure such as a table or other piece of furniture. In some embodiments, base 114 is a fixture in a retail store. Base 114 can be any device, object, or structure that tether cord first end 120 can be coupled to.

Figure 2:
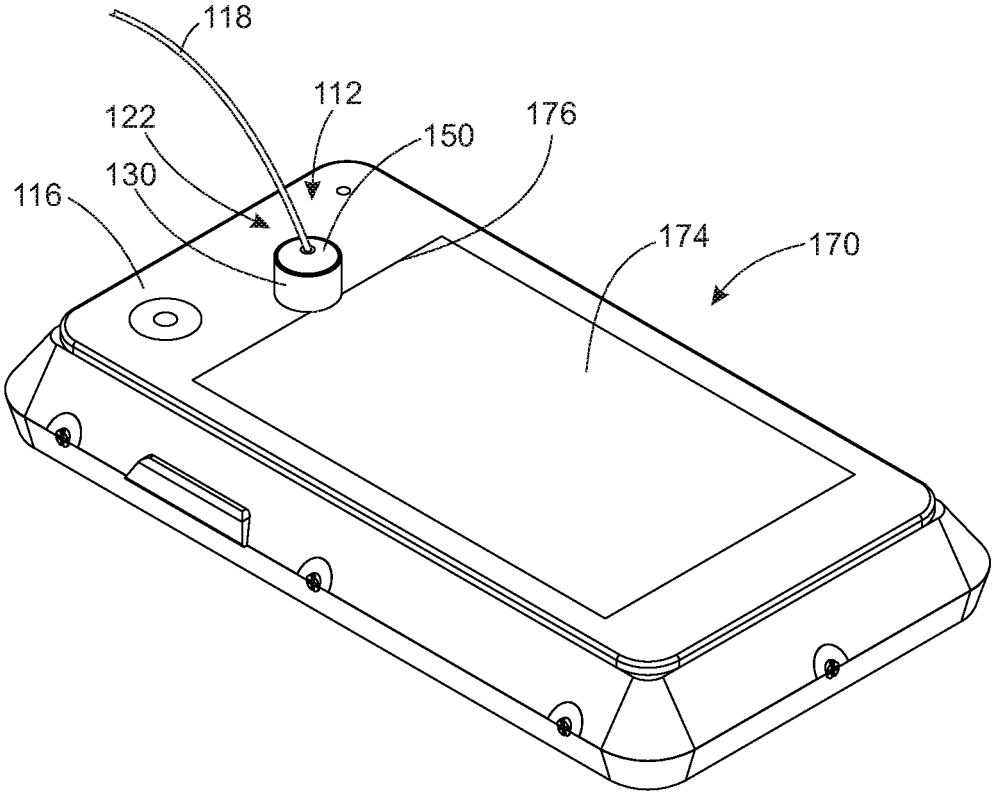
FIG. 2 shows a close up of a coupling apparatus of the tether system of FIG. 1 coupled to the mobile computing device.
Figure 3:
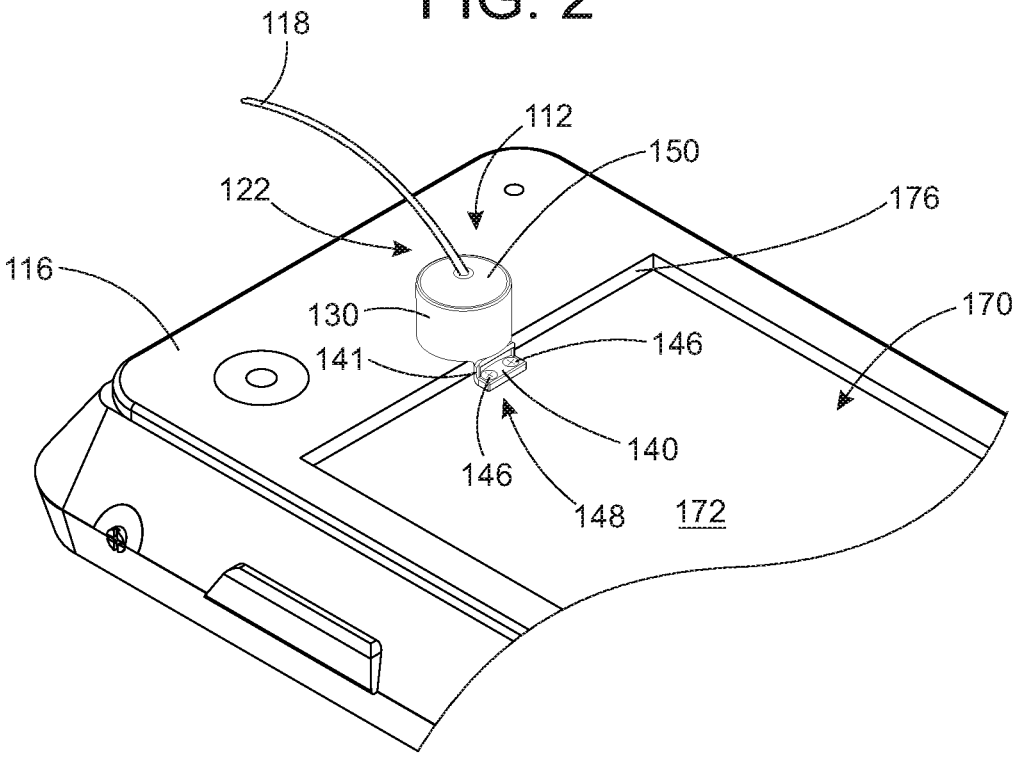
FIG. 3 shows the coupling apparatus of FIG. 2 coupled to the mobile computing device, with a battery compartment lid removed from the mobile computing device.
Figure 4:
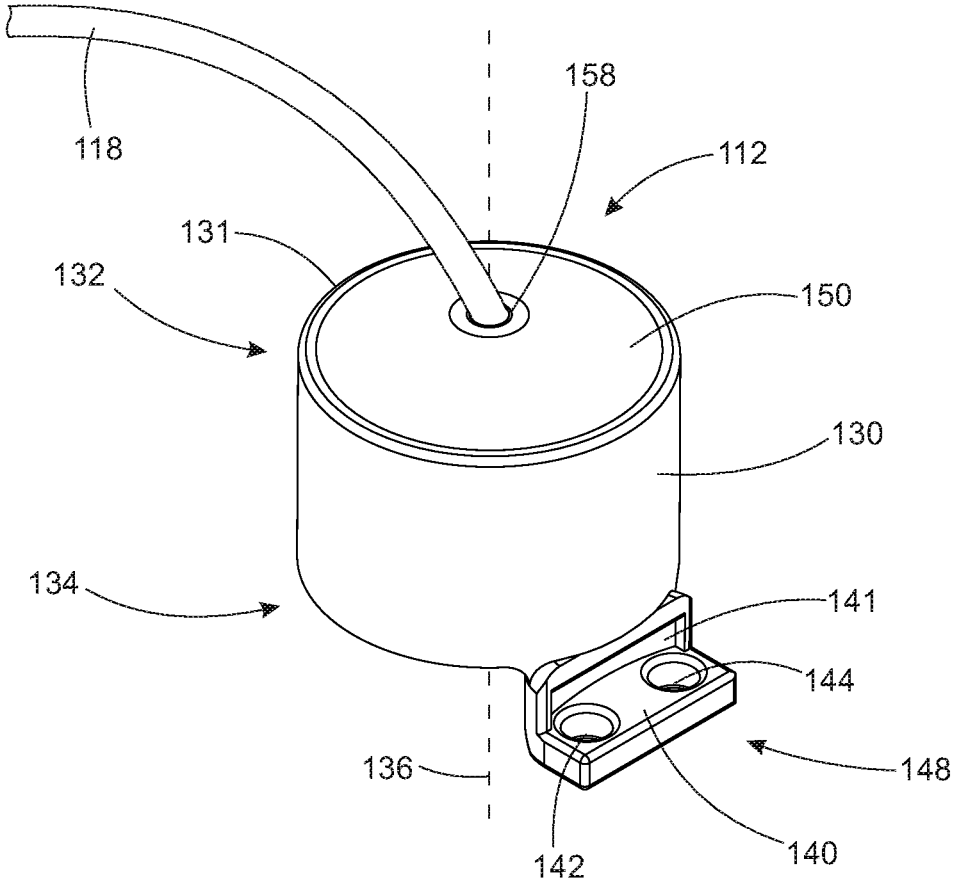
FIG. 4 shows a perspective view of a coupling apparatus for coupling a tether cord to a mobile computing device.
Figure 5:
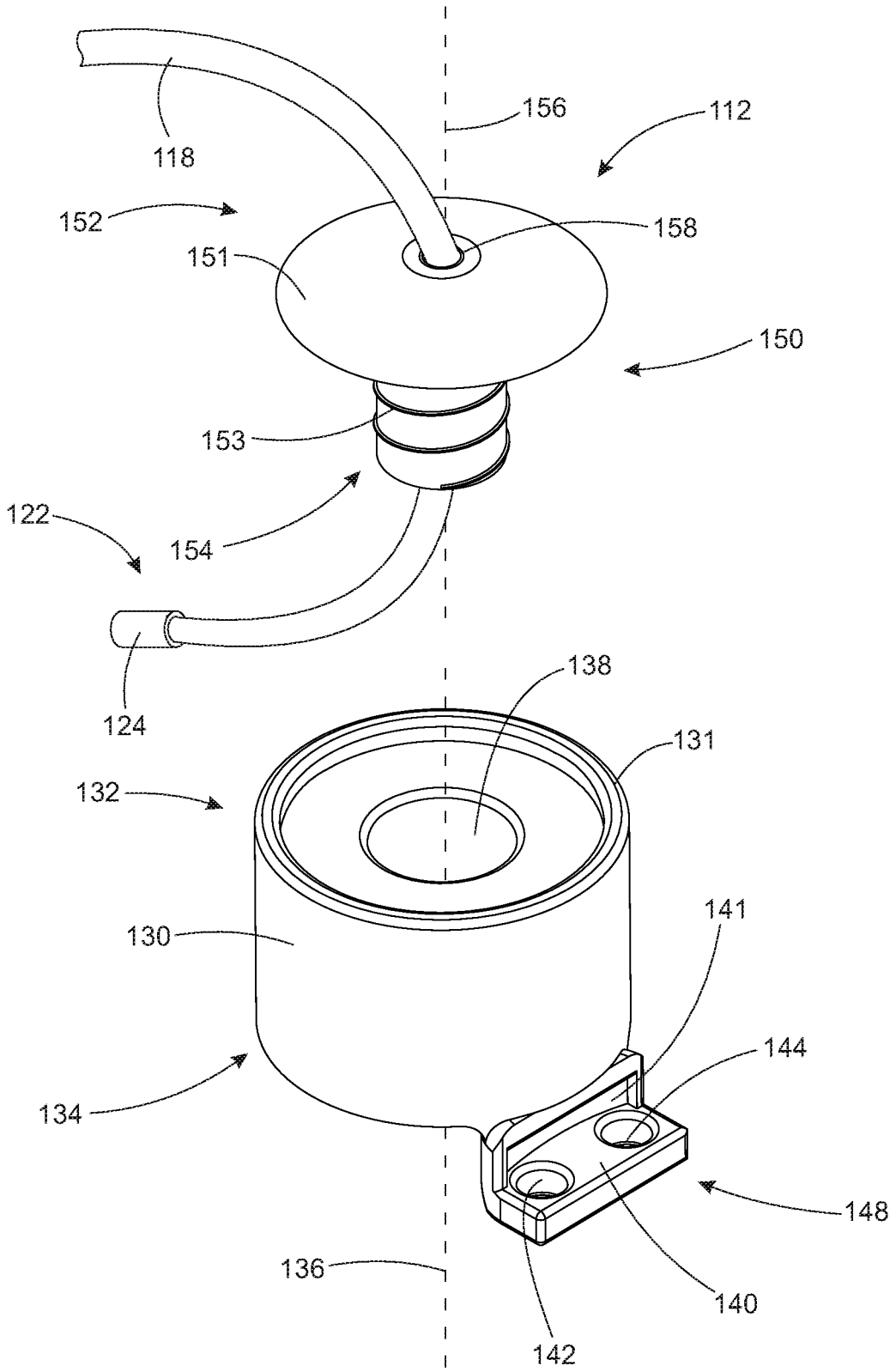
FIG. 5 shows an exploded view of the coupling apparatus of FIG. 4.
Figure 6:
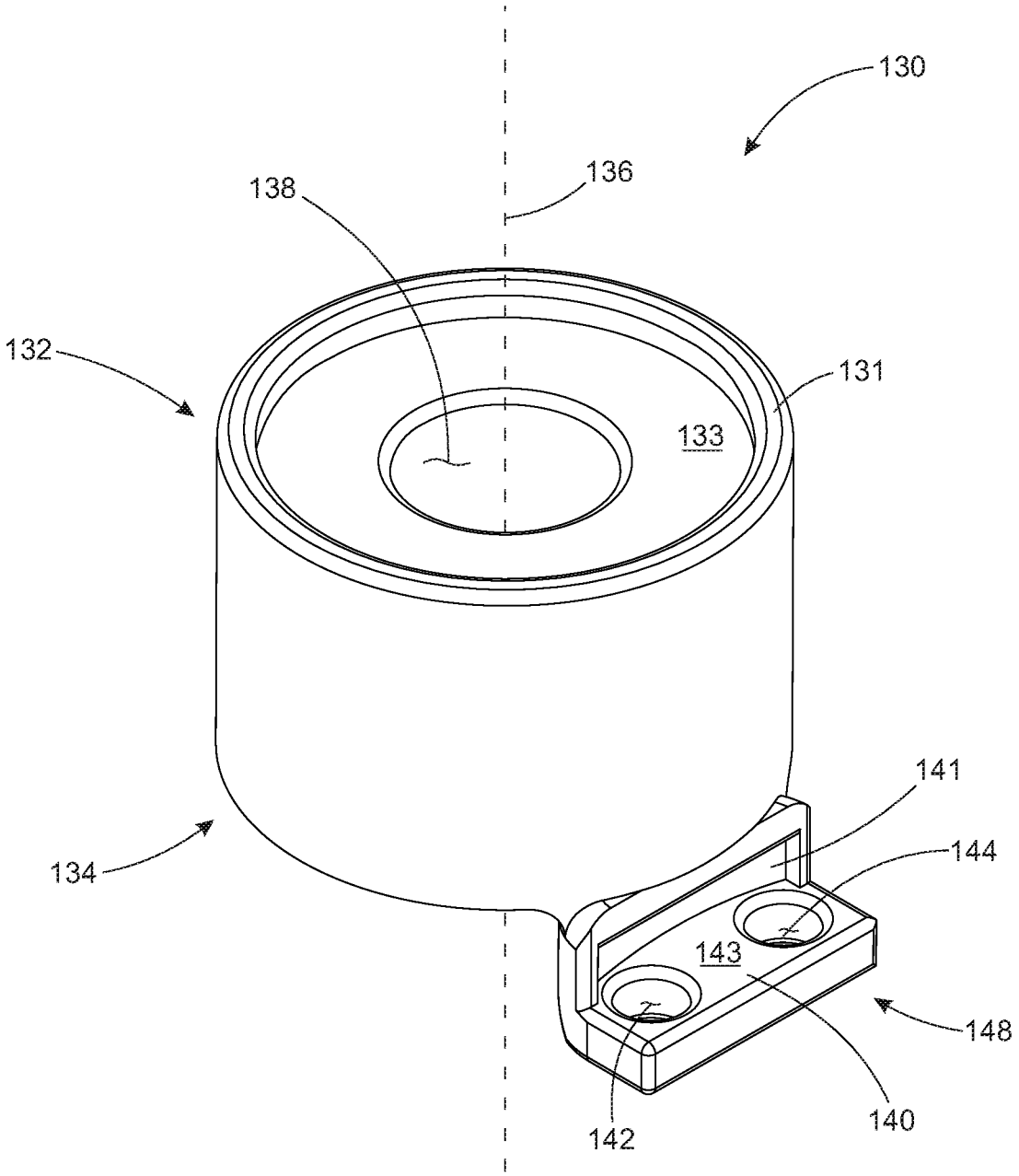
FIG. 6 shows a perspective view of a cylindrical spacer and attachment element.
Figure 7:
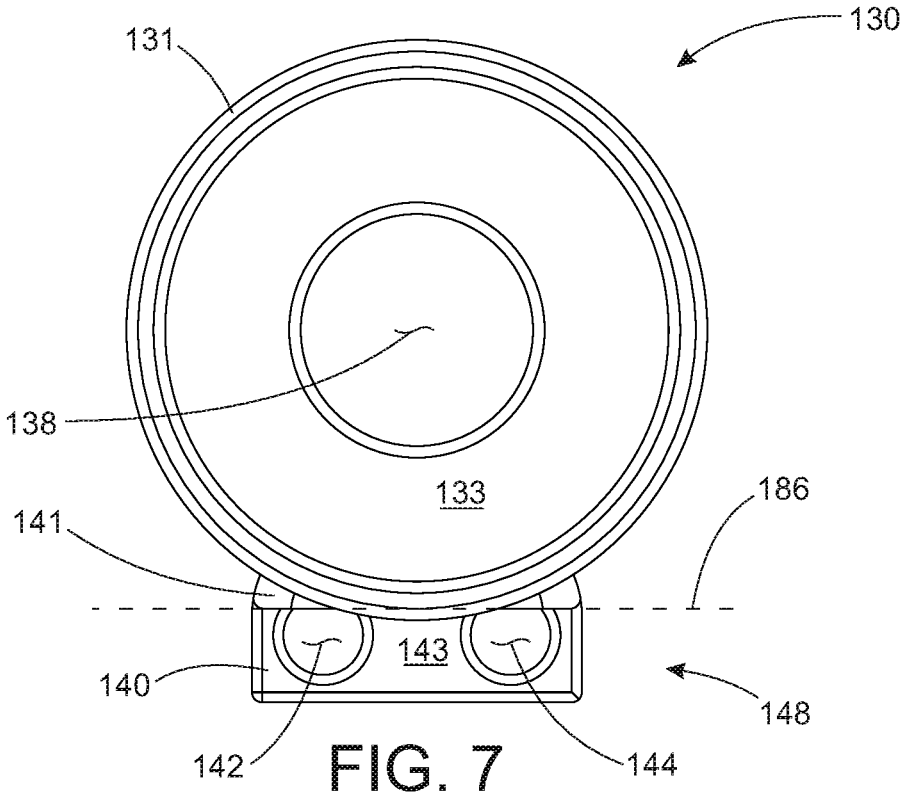
FIG. 7 shows a top view of the cylindrical spacer with attachment element of FIG. 6.
Figure 8:
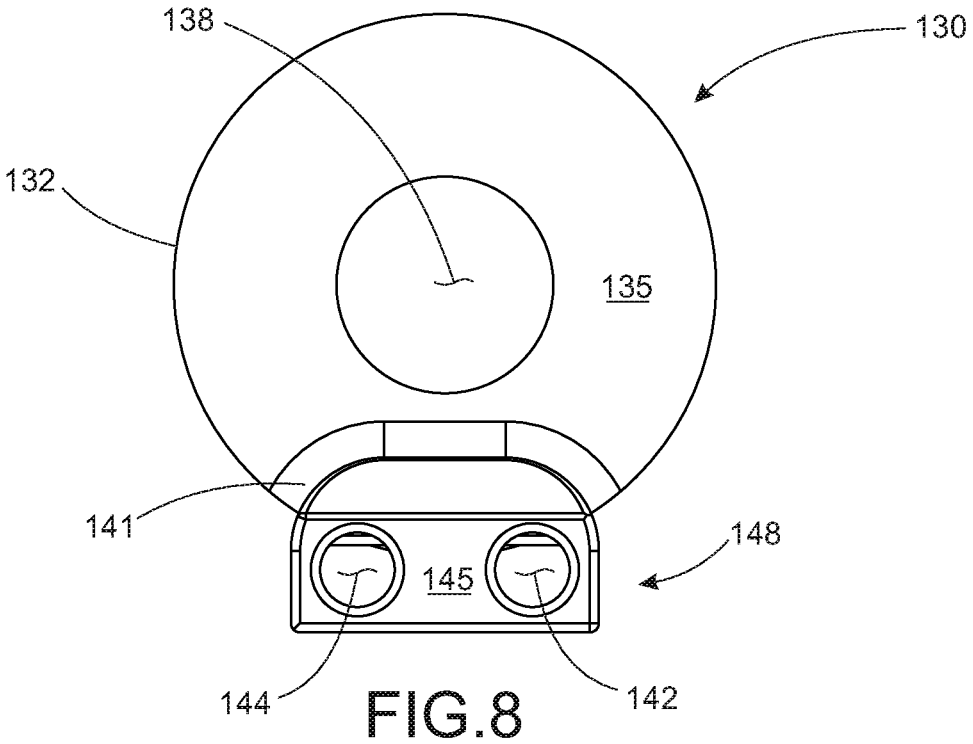
FIG. 8 shows a bottom view of the cylindrical spacer with attachment element of FIG. 6.
Figure 9:
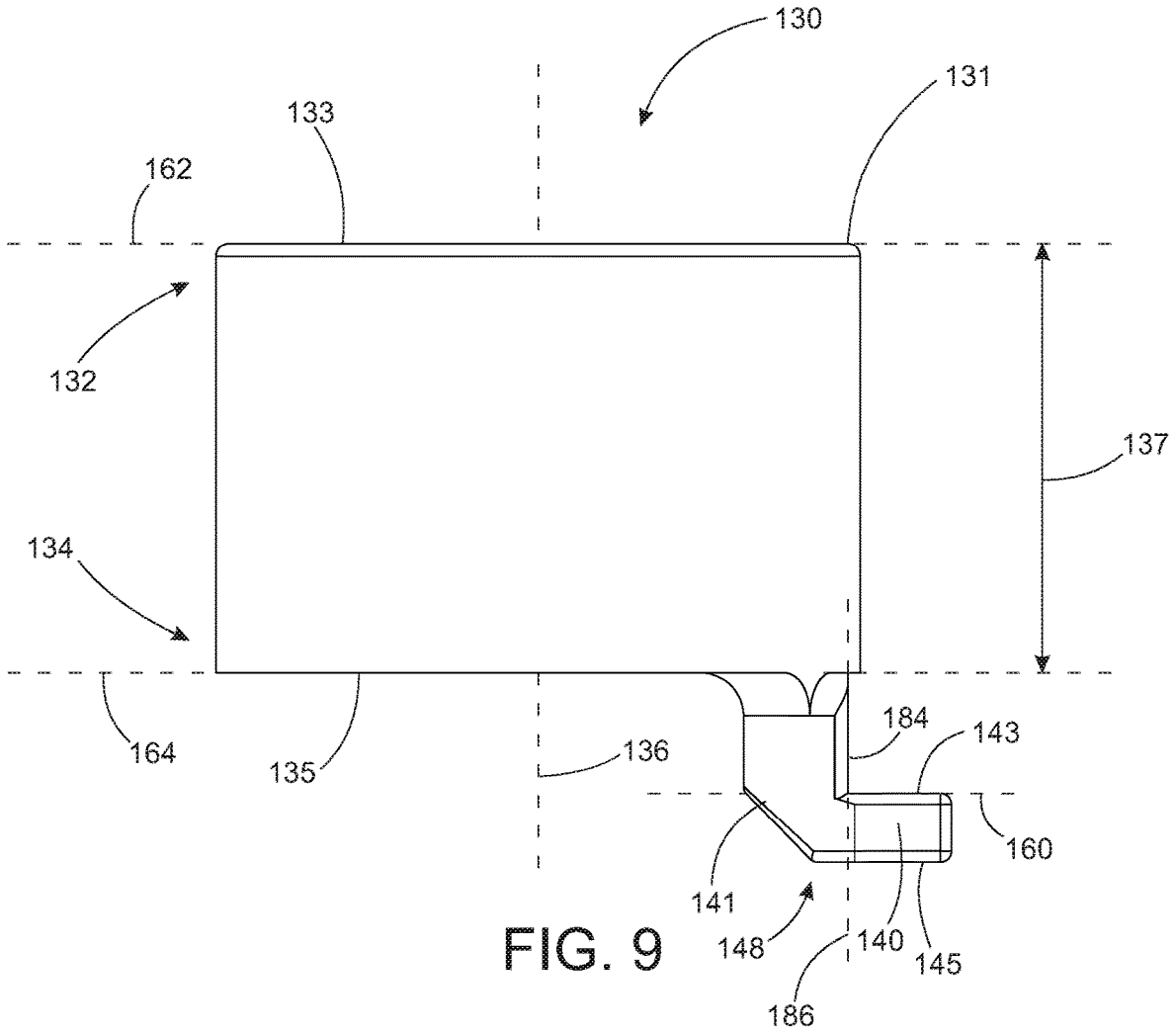
FIG. 9 shows a side view of the cylindrical spacer with attachment element of FIG. 6.

FIG. 2 through FIG. 9 show details of coupling apparatus 112. Coupling apparatus 112 secures mobile computing device 116 to tether cord 118. FIG. 2 shows a close-up perspective view of coupling apparatus 112 coupled to mobile computing device 116. FIG. 3 shows a close-up perspective view of coupling apparatus 112 coupled to mobile computing device 116, with a lid 174 of a battery compartment 170 of mobile computing device 116 removed so that coupling details are visible. FIG. 4 shows a perspective view of coupling apparatus 112. FIG. 5 shows an exploded perspective view of coupling apparatus 112. FIG. 6 shows a top perspective view of a cylindrical spacer 130 of coupling apparatus 112, and an attachment element 148 of coupling apparatus 112. FIG. 7 through FIG. 9 show top, bottom, and side views of cylindrical spacer 130 with attachment element 148.

Coupling apparatus 112, in this embodiment, is coupled to a battery compartment 170 of mobile computing device 116, as shown in FIG. 1, FIG. 2 and FIG. 3. Coupling apparatus 112 includes a cylindrical spacer 130, an attachment element 148 coupled to cylindrical spacer, and a cap screw 150 that screws into cylindrical spacer 130. Tether cord second end 122 is coupled to coupling apparatus 112. Attachment element 148 of coupling apparatus 112 is coupled to an inside surface 172 of battery compartment 170, as shown in FIG. 3, to couple coupling apparatus 112 to mobile computing device 116. Screws 146 extend through first and second screw holes 142 and 144 of an attachment plate 140 of coupling apparatus 112 (FIG. 4, for example), to screw coupling apparatus 112 to mobile computing device 116. In some embodiments, screws 146 are replaced with a different form of fastener or coupler. Any type of fastener or coupler can be used to secure attachment element 148 of coupling apparatus 112 to mobile computing device 116. A neck 141 of attachment element 148 extends through a seam 176 of mobile computing device 116 so that cylindrical spacer 130 and cap screw 150 are outside battery compartment 170, while most of attachment element 148 and screws 146 are inside battery compartment 170, see FIG. 2 and FIG. 3. With attachment plate 140 of attachment element 148 coupled to inside surface 172 and neck 141 extending through seam 176 of battery compartment 170, batteries are installed in battery compartment 170 as usual and battery compartment lid 174 is installed as usual, as shown in FIG. 2. Coupling apparatus 112 is now securely coupled to mobile computing device 116. And mobile computing device 116 is securely coupled to tether cord 118 and base 114, as shown in FIG. 1.

FIG. 4 and FIG. 5 show a perspective view and an exploded perspective view, respectively, of coupling apparatus 112, including cylindrical spacer 130, attachment element 148, and cap screw 150.

Cylindrical spacer 130 takes the form of a thick cylindrical shaped spacer with a spacer hole 138 extending from a spacer top end 132 to a spacer bottom end 134 along a cylindrical axis 136, see FIG. 5 through FIG. 9. In this embodiment, cylindrical spacer 130 is formed of plastic, but this is not meant to be limiting. In some embodiments, cylindrical spacer 130 is formed of metal and spacer hole 138 is threaded. In the embodiment shown in the figures, cylindrical spacer 130 is formed of plastic, with cap screw 150 creating its own threads in spacer hole 138 when cap screw 150 is screwed into spacer hole 138, see FIG. 5. In some embodiments, cylindrical spacer 130 is formed of a self-tapping material such as plastic or wood. In some embodiments, cylindrical spacer 130 is formed of a material such as metal or ceramic that is threaded before cap screw 150 is screwed into cylindrical spacer 130. Cylindrical spacer 130 has a spacer top surface 133 (FIG. 6 and FIG. 7) that is parallel to a spacer top surface plane 162 as shown in FIG. 9. The top edge of spacer top end 132 lies in spacer top surface plane 162. Cylindrical spacer 130 has a spacer bottom surface 135 (FIG. 8) that is parallel to a spacer bottom surface plane 164 as shown in 9. The bottom edge of spacer bottom end 134 lies in spacer bottom surface plane 164.

Cap screw 150 is a screw with a cap screw head 151, a cap screw shaft 153, a cap screw top end 152, a cap screw bottom end 154, and a cap screw hole 158 that extends along a cap screw longitudinal axis 156 from cap screw head 151 at cap screw top end 152, through cap screw shaft 153 to cap screw bottom end 154, see FIG. 5. Cap screw shaft 153 is threaded. Tether cord 118 extends through cap screw hole 158. An aglet 124 is attached to tether cord second end 122 after tether cord 118 is extended through cap screw hole 158, so that cap screw 150 cannot be removed from tether cord 118 at tether cord second end 122, as shown in FIG. 5. Aglet 124 is larger than cap screw hole 158, so aglet 124 does not pass through cap screw hole 158.

Cap screw 150 is coupled to cylindrical spacer 130 by screwing cap screw 150 into spacer hole 138 of cylindrical spacer 130 so that cap screw head 151 is flush with cylindrical spacer top end 132, and cap screw shaft 153 extends into, and is threaded into, spacer hole 138, as shown in FIG. 4 and FIG. 5. Cap screw longitudinal axis 156 is colinear with cylindrical axis 136 when cap screw 150 is screwed into spacer hole 138, see FIG. 5. Cylindrical spacer 130 is formed to have a depth 137 (see FIG. 9) greater than the length of cap screw shaft 153 so that cap screw shaft 153 does not protrude from cylindrical spacer bottom end 134. Once tether cord second end 122 of tether cord 118 is coupled to cap screw 150, cap screw 150 is screwed onto spacer hole 138 of cylindrical spacer 130 to couple cylindrical spacer 130 to cap screw 150, tether cord 118, and base 114. Cylindrical spacer 130 has an annular lip 131 at cylindrical spacer top end 132 so that cap screw head 151 is slightly inset into cylindrical spacer top end 132, as shown in FIG. 4 and FIG. 5. Cap screw head 151 sets on cap screw top surface 133.

Attachment element 148 is coupled to cylindrical spacer 130 and is used to couple cylindrical spacer 130 to mobile computing device 116. In some embodiments, attachment element 148 and cylindrical spacer 130 are formed as a monolithic structure, usually molded in plastic, but not always. Attachment element 148 includes attachment plate 140 and attachment neck 141, as shown in FIG. 4 through FIG. 9. Attachment neck 141 couples attachment plate 140 to cylindrical spacer 130. Attachment neck 141 is a somewhat rectangular shaped element in this embodiment, but this is not meant to be limiting. Attachment neck 141 is coupled to both cylindrical spacer 130 and attachment plate 140. Attachment neck 141 extends from cylindrical spacer 130 at spacer bottom end 134. Attachment neck 141 has a flat neck front surface 184, see FIG. 9, which lies in a neck plane 186. Neck plane 186 is tangential to cylindrical spacer 130, see FIG. 7. Having neck plane 184 tangential to cylindrical spacer 130 helps attachment element 148 fit through seam 176 of mobile computing device 116. Neck plane 186 being tangential to cylindrical spacer 130 means neck plane 186 is tangential to the outer surface of cylindrical spacer 130.

Attachment plate 140 is a relatively rectangular shaped plate coupled to attachment neck 141. Attachment plate 140 is used to couple cylindrical spacer 130 of coupling apparatus 112 to mobile computing device 116. Attachment plate 140 has a flat attachment plate top surface 143 lying in an attachment plate plane 160, see FIG. 9. Attachment plate plane 160 is parallel to spacer top surface plane 162 and spacer bottom surface plane 164. Attachment plate plane 160 is perpendicular to neck plane 186, see FIG. 9. Attachment plate 140 is configured to be coupled to mobile computing device 116. Attachment plate 140 is configured to be coupled to a mobile computing device using two coupling holes 142 and 144, in this embodiment. In this embodiment, screws 146 are extended through coupling holes 142 and 144 and then into mobile computing device 116 to couple attachment plate 140, attachment element 148, and cylindrical spacer 130 to mobile computing device 116. In some embodiments, attachment plate 140 is configured to couple to mobile computing device 116 using other coupling means or methods.

Attachment plate 140 has attachment plate top surface 143, and an attachment plate bottom surface 145 (FIG. 8). Attachment plate bottom surface 145 is parallel to a spacer top surface 133 at spacer top end 132, and a spacer bottom surface 135 of spacer bottom end 134, as shown in FIG. 6 and FIG. 9, and is also parallel to spacer top surface plane 162 and spacer bottom surface plane 164.

In this embodiment, cylindrical spacer 130 and attachment element 148 are a monolithic structure, but this is not meant to be limiting. In some embodiments, attachment element 148 is formed separate from cylindrical spacer 130, and coupled to cylindrical spacer 130.

Figure 10:
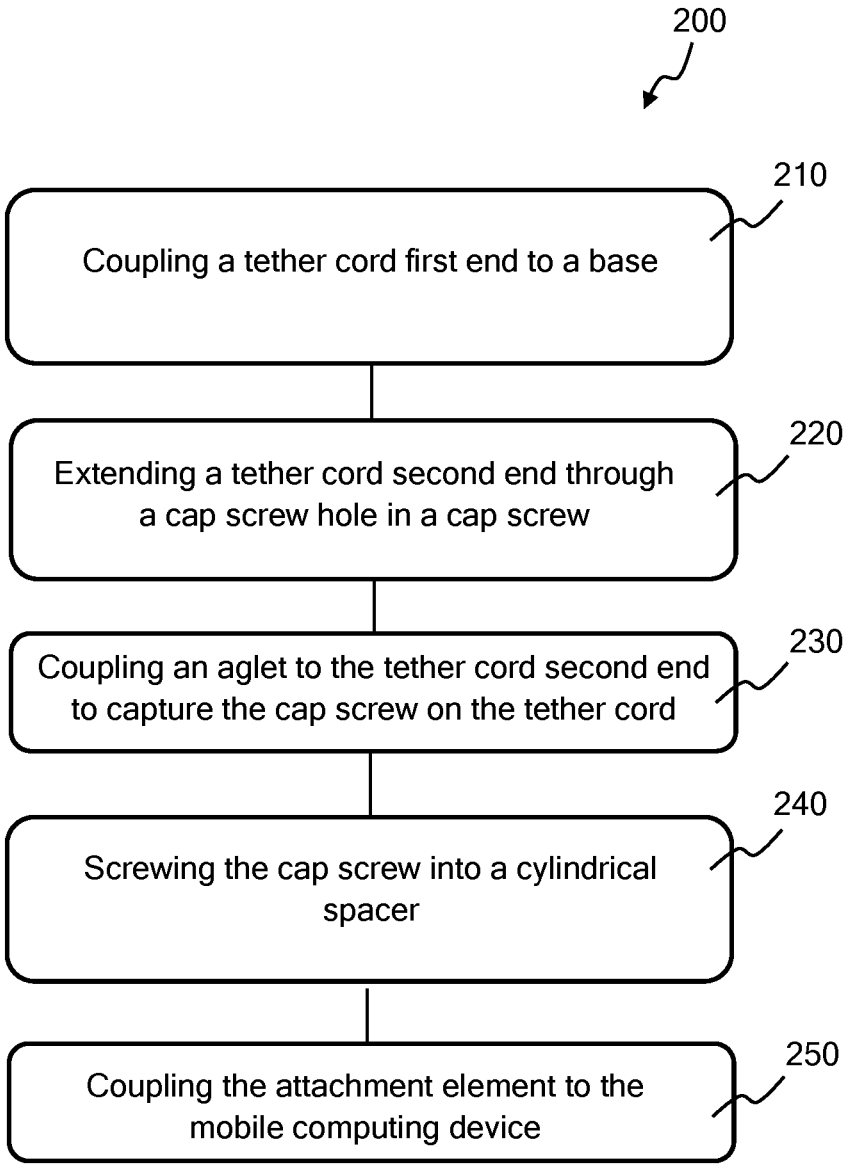
FIG. 10 illustrates a method of securing a mobile computing device to a base.

FIG. 10 illustrates a method 200 of securing a mobile computing device to a base. Method 200 includes an act 210 of coupling a tether cord first end of a tether cord to a base. The tether cord can be any type of cord, string, or wire that can tether one object to another. The tether cord is retractable onto a reel in some embodiments. In some embodiments, the base is a rectangular box with coupling holes used to couple the base to an object such as a table, a charger, a wall, etc. In some embodiments, the base is a different shape or form of a device to be coupled to another object. In some embodiments, the base is a fixed structure such as a table, a wall, a bookcase, a checkout stand, or any other fixed structure that it is desired to tether a mobile computing device to. The base can be any device, object, or structure that tether cord second end can be coupled to. The tether cord first end can be coupled to the base using any coupling means and/or methods.

Method 200 also includes an act 220 of extending a tether cord second end through a cap screw hole in a cap screw. The cap screw is a screw with a cap screw head, a cap screw shaft, and a longitudinal axis. In some embodiments, the cap screw hole extends longitudinally through the cap screw from a cap screw top end to a cap screw bottom end through the cap screw shaft. In some embodiments, method 200 includes drilling the cap screw hole in the cap screw longitudinally from the cap screw top end to the cap screw bottom end.

Method 200 also includes an act 230 of coupling an aglet to the tether cord second end to capture the cap screw onto the tether cord. The aglet has a size larger than the cap screw hole so that the aglet cannot pass through the cap screw hole. The aglet is coupled to the tether cord second end after the second end is passed through the cap screw hole to prevent the cap screw from being removed from the tether cord at the tether cord second end. The base keeps the cap screw from being removed from the tether cord at the tether cord first end. The aglet and the base capture the cap screw on the tether cord.

Method 200 also includes an act 240 of screwing the cap screw into a cylindrical spacer. The cylindrical spacer has an attachment element. The cylindrical spacer includes a spacer top end, a spacer bottom end, a cylindrical axis and a spacer hole extending between the spacer top end and the spacer bottom end along the cylindrical axis. The attachment element includes an attachment plate and an attachment neck. The attachment plate has a flat attachment plate top surface lying in an attachment plate plane. The attachment plate plane is parallel to a spacer top surface plane and a spacer bottom surface plane. The attachment plate is configured to be coupled to a mobile computing device. The attachment neck is coupled to the attachment plate. The attachment neck is coupled to, and extends from, the cylindrical spacer at the spacer bottom end. The attachment neck couples the attachment plate to the cylindrical spacer.

Screwing the cap screw into the cylindrical spacer couples the cap screw and the tether to the cylindrical spacer. In some embodiments, screwing the cap screw into the cylindrical spacer includes screwing the cap screw into the spacer hole. In some embodiments, the cap screw makes its own threads in the spacer hole when the cap screw is screwed into the spacer hole. In some embodiments, the spacer hole is threaded. In some embodiments, the cap screw is coupled to the cylindrical spacer by means other than screwing the cap screw into the spacer hole.

Method 200 also includes an act 250 of coupling the attachment element to the mobile computing device. Coupling the attachment element to the mobile computing device couples the cylindrical spacer to the mobile computing device. The attachment element can be coupled to the mobile computing device in many ways. In some embodiments, the attachment element includes the attachment plate, and coupling the attachment element to the mobile computing device includes coupling the attachment plate to the mobile computing device. In some embodiments, coupling the attachment element to the mobile computing device includes coupling the attachment plate to an inside surface of a battery compartment of the mobile computing device.

A tether system has been shown and described. The tether system tethers a mobile computing device to a base. The tether system allows the mobile computing device to be used by any number of individuals, but does not allow the mobile computing device to be moved further away from the base than the length of the tether. This keeps the mobile computing device from getting lost or stolen. The tether system includes a tether cord with a first end coupled to a base and a second end coupled to a coupling apparatus. The base can be a fixed structure or can be coupled to a fixed structure at the location where the mobile computing device should be kept. The coupling apparatus is coupled to the mobile computing device. With the coupling apparatus coupling one end of the tether cord to the mobile computing device, and the other end of the tether cord coupled to the base, the tether cord couples the mobile computing device to the base. The coupling apparatus includes a cylindrical spacer with an attachment element, and a cap screw. The cap screw is coupled to the tether cord. The cap screw is screwed into a spacer hole in the cylindrical spacer to couple the cylindrical spacer and the cap screw. The attachment element is coupled to the mobile computing device to couple the coupling apparatus to the mobile computing device.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A coupling apparatus for securing a mobile computing device to a tether cord, the coupling apparatus comprising:
- a cylindrical spacer having a spacer top end, a spacer bottom end, a cylindrical axis and a spacer hole extending between the spacer top end and the spacer bottom end along the cylindrical axis;
- an attachment element comprising:
  - an attachment plate, wherein the attachment plate has a flat attachment plate top surface lying in an attachment plate plane, wherein the attachment plate plane is parallel to a spacer top surface plane and a spacer bottom surface plane of the cylindrical spacer, and wherein the attachment plate comprises at least one screw hole through the attachment plate to receive a fastener to secure the cylindrical spacer to the mobile computing device; and
  - an attachment neck coupled to the attachment plate, wherein the attachment neck is coupled to, and extends from, the cylindrical spacer at the spacer bottom end, and wherein the attachment neck couples the attachment plate to the cylindrical spacer; and
- a cap screw with a cap screw hole extending longitudinally through the cap screw, wherein the tether cord extends through the cap screw hole, and wherein the cap screw is coupled to the cylindrical spacer.

2. The coupling apparatus of claim 1, wherein the attachment neck comprises a flat neck front surface lying in a neck plane, wherein the neck plane is tangential to the cylindrical spacer.

3. The coupling apparatus of claim 2, wherein the neck plane is perpendicular to the attachment plate plane.

4. The coupling apparatus of claim 1, wherein the cylindrical spacer and the attachment element are formed as a monolithic structure.

5. The coupling apparatus of claim 1, wherein the cylindrical spacer comprises an annular lip at the spacer top end.

6. The coupling apparatus of claim 1, wherein the cap screw is screwed into the spacer hole to couple the cap screw to the cylindrical spacer.

7. A tether system comprising:
- a base;
- a cap screw comprising:
  - a cap screw head;
  - a cap screw shaft; and
  - a cap screw hole extending longitudinally through the cap screw from a cap screw top end to a cap screw bottom end opposing the cap screw top end;
- a tether cord comprising:
  - a tether cord first end coupled to the base; and
  - a tether cord second end opposing the tether cord first end, wherein the tether cord extends through the cap screw hole;
- a cylindrical spacer coupled to the cap screw, the cylindrical spacer comprising:
  - a spacer top end;
  - a spacer bottom end;
  - a cylindrical axis; and
  - a spacer hole extending between the spacer top end and the spacer bottom end along the cylindrical axis; and
- an attachment element extending from the cylindrical spacer at the spacer bottom end, the attachment element comprising:
  - an attachment plate, wherein the attachment plate has a flat attachment plate top surface lying in an attachment plate plane, and wherein the attachment plate plane is parallel to a spacer top surface plane and a spacer bottom surface plane of the cylindrical spacer; and
  - an attachment neck coupled to the attachment plate, wherein the attachment neck is coupled to, and extends from, the cylindrical spacer at the spacer bottom end, wherein the attachment neck couples the attachment plate to the cylindrical spacer, wherein the attachment neck comprises a flat neck front surface lying in a neck plane, wherein the neck plane is tangential to the cylindrical spacer, and wherein the neck plane is perpendicular to the attachment plate plane.

8. The tether system of claim 7, wherein the tether cord couples the base to the cap screw.

9. The tether system of claim 8, wherein the tether cord second end comprises an aglet, and wherein the aglet keeps the cap screw from being removed from the tether cord second end.

10. The tether system of claim 7, wherein the attachment plate is configured to be coupled to a mobile computing device.

11. The tether system of claim 7, wherein the cap screw is threaded into the spacer hole to couple the cylindrical spacer to the cap screw.

12. A method of securing a mobile computing device to a base, the method comprising:
- coupling a tether cord first end of a tether cord to the base;
- extending a tether cord second end of the tether cord through a cap screw hole in a cap screw;
- coupling an aglet to the tether cord second end to capture the cap screw on the tether cord;
- screwing the cap screw into a cylindrical spacer having an attachment element, wherein the cylindrical spacer comprises:
  - a spacer top end;
  - a spacer bottom end;
  - a cylindrical axis; and
  - a spacer hole extending between the spacer top end and the spacer bottom end along the cylindrical axis;

and wherein the attachment element comprises:

an attachment plate, wherein the attachment plate has a flat attachment plate top surface lying in an attachment plate plane, wherein the attachment plate plane is parallel to a spacer top surface plane and a spacer bottom surface plane of the cylindrical spacer, and wherein the attachment plate comprises at least one screw hole through the attachment plate to receive a fastener to secure the cylindrical spacer to the mobile computing device; and an attachment neck coupled to the attachment plate, wherein the attachment neck is coupled to, and extends from, the cylindrical spacer at the spacer bottom end, and wherein the attachment neck couples the attachment plate to the cylindrical spacer;

and coupling the attachment element to the mobile computing device.

13. The method of claim 12, wherein the cap screw hole extends longitudinally through the cap screw from a cap screw top end to a cap screw bottom end.

14. The method of claim 12, wherein the screwing the cap screw into the cylindrical spacer comprises screwing the cap screw into the spacer hole.

15. The method of claim 12, wherein the coupling the attachment element to the mobile computing device comprises coupling the attachment plate to an inside surface of a battery compartment of the mobile computing device.

* * * * *